US011383904B2

(12) United States Patent
Rivelli

(10) Patent No.: US 11,383,904 B2
(45) Date of Patent: Jul. 12, 2022

(54) PLASTIC BOTTLE EQUIPPED WITH A TAMPERPROOF DEVICE AFTER ITS OPENING

(71) Applicant: Paolo Rivelli, Naples (IT)

(72) Inventor: Paolo Rivelli, Naples (IT)

( * ) Notice: Subject to any disclaimer, the term of this patent is extended or adjusted under 35 U.S.C. 154(b) by 0 days.

(21) Appl. No.: 16/762,426

(22) PCT Filed: Nov. 7, 2018

(86) PCT No.: PCT/IB2018/058733
§ 371 (c)(1),
(2) Date: May 7, 2020

(87) PCT Pub. No.: WO2019/092602
PCT Pub. Date: May 16, 2019

(65) Prior Publication Data

US 2020/0262627 A1 Aug. 20, 2020

(30) Foreign Application Priority Data

Nov. 7, 2017 (IT) ..... 102017000126807

(51) Int. Cl.
*B65D 55/06* (2006.01)
*B65D 41/34* (2006.01)
*B65D 55/10* (2006.01)

(52) U.S. Cl.
CPC ..... *B65D 55/06* (2013.01); *B65D 41/34* (2013.01); *B65D 55/10* (2013.01); *B65D 2401/20* (2020.05)

(58) Field of Classification Search
CPC ..... B65D 55/06; B65D 55/10; B65D 55/024; B65D 55/12; B65D 41/34; B65D 41/3419;
(Continued)

(56) References Cited

U.S. PATENT DOCUMENTS 2,140,732 A * 12/1938 Burke ..... B65D 55/02 215/251
4,479,585 A * 10/1984 Sandhaus ..... B65D 50/046 215/216
(Continued)

FOREIGN PATENT DOCUMENTS

CH 244568 A * 9/1946 ..... B43K 23/128
CH 244568 A 9/1946
(Continued)

*Primary Examiner* — J. Gregory Pickett
*Assistant Examiner* — Abigail Elizabeth Guidry
(74) *Attorney, Agent, or Firm* — Browdy and Neimark, P.L.L.C.

(57) ABSTRACT

A plastic bottle equipped with a tamperproof device after its opening comprises a neck (1) and a cap (2) with corresponding screw threads (3, 4). The cap (2) is provided in its skirt (6) with at least one slide (22) and one pin (8) manually sliding into the slide (22). Below its screw threads (3) the cap (2) has a nut ring (9) that is provided with a plurality of holes (10); one of these is intended to receive and hold an arrow-tip end (18) of the pin (8) until its breakage in its weakened tract (17) when the cap (2) is unscrewed for opening. In addition, the pin (8) has an elongated projection (13) for its manual sliding inside the cutout (12) in a convex band (7) whose interior contains the slide (22) of the pin (8). The cutout has a lower end working as a stop for the pin (8).

6 Claims, 5 Drawing Sheets

(58) Field of Classification Search
CPC ..... B65D 41/3423; B65D 41/32; B65D 41/3409; B65D 41/3428; B65D 2401/20; B65D 2401/15; B65D 51/002; B65D 1/0238; B65D 2255/20; Y10S 215/901
See application file for complete search history.

(56) References Cited

U.S. PATENT DOCUMENTS 4,512,484 A * 4/1985 Mar ..... B65D 55/10 206/1.5
4,706,828 A * 11/1987 Zinnbauer ..... B65D 41/3447 215/246
4,726,482 A * 2/1988 Barriac ..... B65D 41/3428 215/252
4,778,070 A * 10/1988 Walker ..... B65D 55/10 215/232
4,989,739 A * 2/1991 Falcone ..... B65D 55/10 215/221
5,219,084 A * 6/1993 King ..... B65D 41/0428 215/252
5,476,181 A * 12/1995 Seidler ..... G01F 11/286 215/223
5,893,475 A * 4/1999 May ..... B65D 55/06 215/252
6,866,162 B2 * 3/2005 Morris, Sr. ..... B65D 55/10 220/288
7,513,384 B2 * 4/2009 Morris, Sr. ..... B65D 50/046 215/216
8,286,819 B1 * 10/2012 Morris, Jr. ..... B65D 50/048 220/326
2011/0089176 A1 * 4/2011 Hale ..... G09F 3/0317 220/324
2011/0163119 A1 * 7/2011 Nyambi ..... B65D 47/243 222/1
2016/0264326 A1 * 9/2016 Young ..... B65D 21/083
2021/0080224 A1 * 3/2021 Searle ..... A45C 5/00

FOREIGN PATENT DOCUMENTS

CH 676353 A5 * 1/1991 ..... B65D 47/0885
CN 102582951 A 7/2012
CN 103318520 A 9/2013
EP 1104064 A1 * 5/2001 ..... H02B 1/46
FR 1562178 A 4/1969
FR 2159203 A1 * 6/1973 ..... B65D 55/024
FR 2159203 A1 6/1973
WO WO-9609969 A1 * 4/1996 ..... E05B 73/0023
WO 2011000066 A1 1/2011
WO WO-2012136417 A1 * 10/2012 ..... B65D 41/3428
WO WO-2014080836 A1 * 5/2014 ..... B65D 41/0471
WO WO-2018189105 A1 * 10/2018 ..... B65D 41/34

* cited by examiner

PLASTIC BOTTLE EQUIPPED WITH A TAMPERPROOF DEVICE AFTER ITS OPENING

TECHNICAL FIELD

The present invention concerns a plastic bottle provided with a tamperproof device after its opening.

BACKGROUND ART

When a bottle, for instance of mineral water or other drink, is left unsealed and unattended, for instance in a working or leisure environment, and taken again after a certain time, the only way to find out if it was used by someone other than the user, is to compare the level of liquid contained in the bottle with the level present when it was first left. It should be understood that the problem is not only to detect if someone drank your water, perhaps laying the lips on the neck of the bottle, but also to verify that the cap has not been unscrewed, e.g. to pour inside some extraneous substances, and then re-screwed.

Presently, in the Applicant's opinion, in order not to incur in the risks above listed, it is necessary that everyone always carries the bottle with him/her.

U.S. Pat. No. 5,893,475 discloses a tamperproof container having a main body with an opening and a closure. One or more tamperproof indicators have leg portions engageable within respective of apertures around the peripheral ledge of the closure. Rotation of the closure will result in the legs engaging with a respective abutment provided on the main body of the container, with consequent breaking thereof. This shows an attempt to remove the closure. However, since the leg portions simply abut against the abutment of the main body of the container, it is probable on the one hand that the leg portions are not severed and, therefore, an evidence of the violation attempt does not remain. On the other hand, if the leg portions were sheared, all the tamperproof indicator would be expelled from the closure, and then the evidence of violation would fail.

U.S. Pat. Nos. 4,989,739 and 4,512,484 describe safety containers with screw caps provided with locking means to prevent their opening by children. They both describe a cap with a non-fracturing through pin which is difficult to remove from the children.

FR 1,562,178 describes a device similar to that of U.S. Pat. No. 5,893,475, but the tamperproof indicator is difficult to replace.

SUMMARY OF INVENTION

The closest prior art is considered U.S. Pat. No. 5,893,475, and the present invention aims to overcome the drawbacks above cited.

The main purpose of the present invention is to permit to check that a sealed bottle, opened for its first use, and later re-closed by the user, has not been subsequently opened by other persons to drink or to corrupt its content.

Strictly connected to this is the purpose of verifying as a clear evidence that a device, functioning as a bolt, has been severed and is still on the bottle.

Another purpose of the invention is to allow several times the re-closure of the bottle in use, guaranteeing each time that it has not been re-opened by others to drink or to corrupt its content.

In order to reach the purpose above mentioned, the present invention supplies a bottle with a screw cap equipped, alone or in combination with the bottle itself, with a device functioning as bolt, as defined in the claim 1 here attached and in the claims depending from it. Since, in evidencing the tampering, the device functioning as bolt breaks and thence is no more re-usable, advantageously, several devices can be contemplated in compliance with the invention on the same screw cap.

BRIEF DESCRIPTION OF DRAWINGS

Further features and advantages of the invention will result more evident by the description of embodiments of a plastic bottle equipped with a tamperproof device after its opening, illustrated, as an indicative and not limiting example, in the drawings here attached, where.

DESCRIPTION OF EMBODIMENTS OF THE INVENTION

Figure 1:
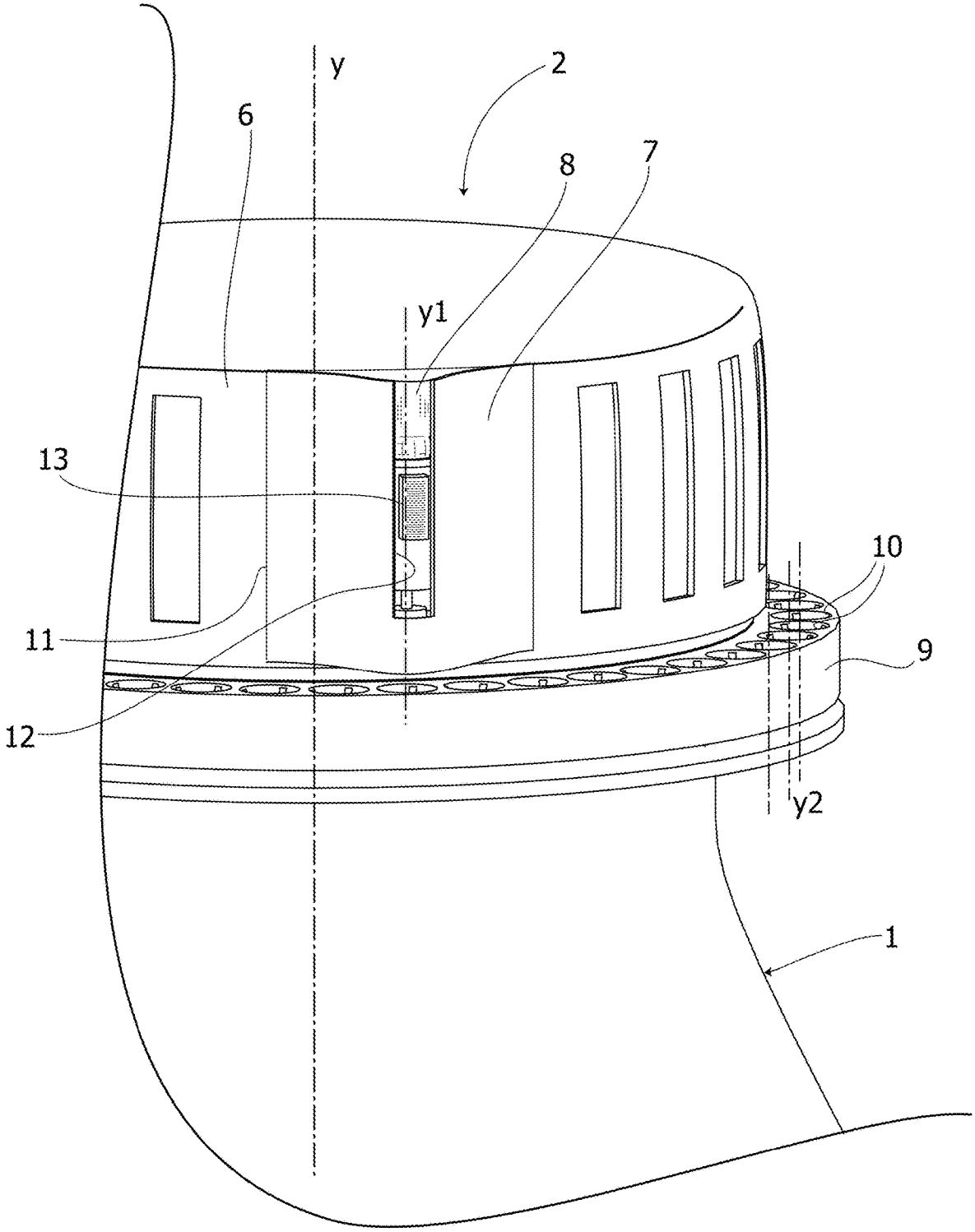
FIG. 1 is a schematic perspective view of a portion of neck and screw cap of a first embodiment of a plastic bottle no more unsealed, where the tamperproof device in compliance with the invention is not activated.
Figure 2:
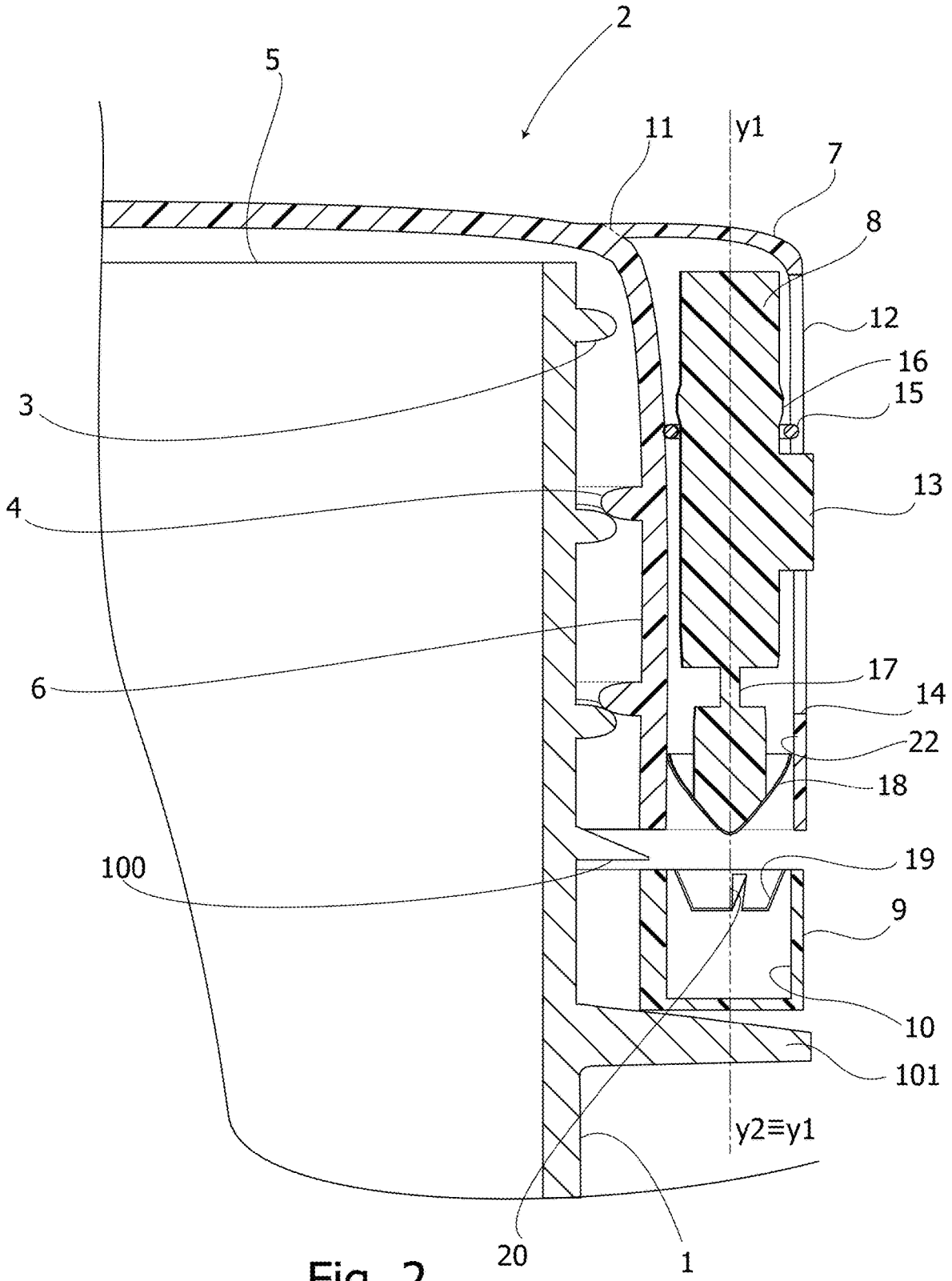
FIG. 2 is an enlarged partial schematic cross section of FIG. 1 according to a diametrical plan passing through the tamperproof device not activated.
Figure 3:
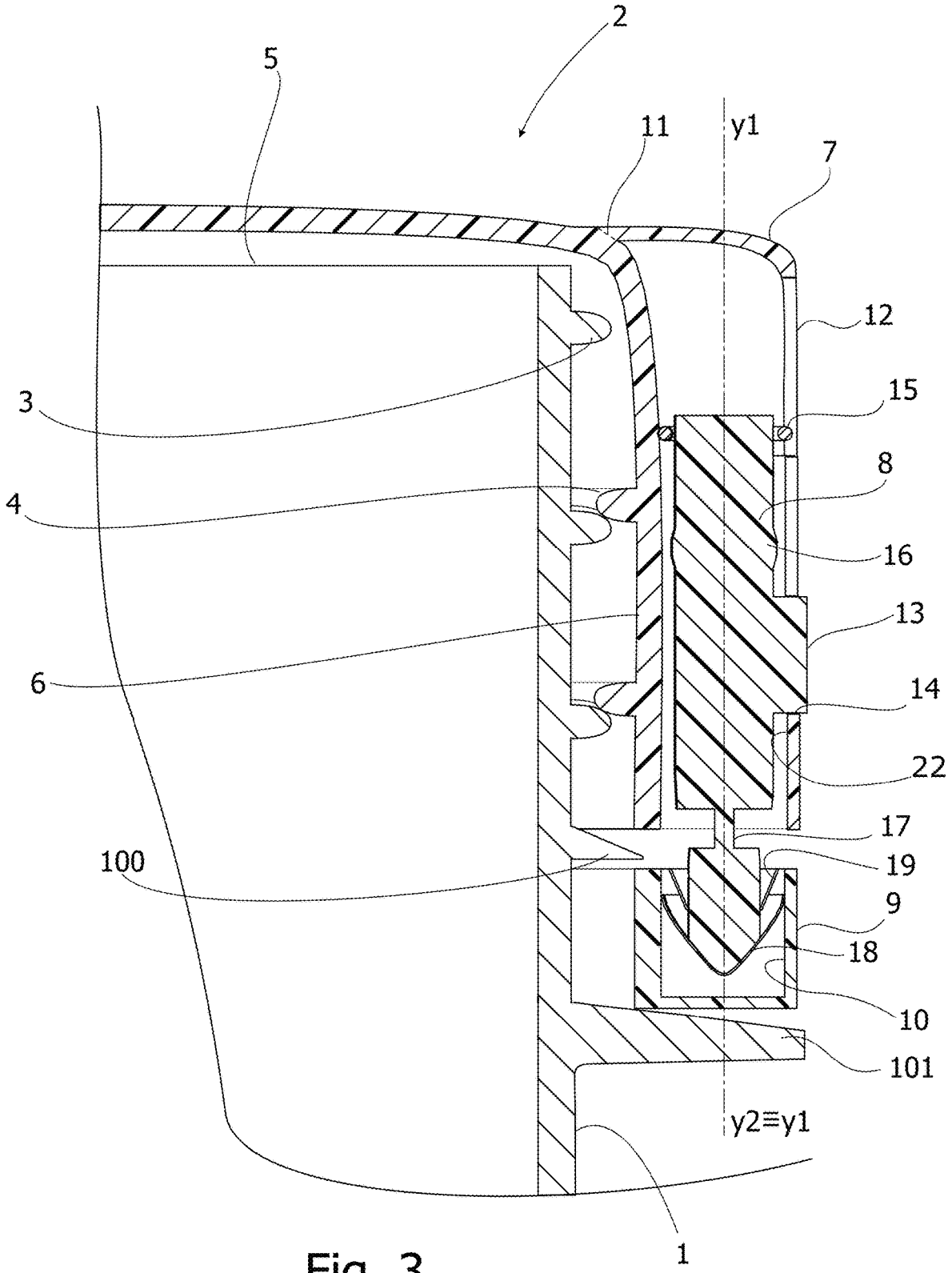
FIG. 3 is an enlarged partial schematic cross section of FIG. 1 according to a diametrical plan passing through the activated tamperproof device.

Initially, reference is made to FIGS. 1 to 3 which are a schematic perspective view and relevant fragmentary enlarged radial cross-section views of a portion of neck and screw cap of a first embodiment of a plastic bottle in which a tamper-proof device according to the invention is not activated and activated, respectively. In these figures a bottle neck is indicated as 1 and a cap as 2. Conventionally, the bottle neck 1 and the cap 2 have correspondingly an external screw thread 3 and an internal screw thread 4, the one in proximity of the bottle mouth 5, the other on the facing skirt 6 of the cap. The cap 2, which is in plastic like the bottle, has, like the bottle, a symmetry axis y. The bottle is no more sealed, since the cap skirt 6 is no more attached at the bottom to a retaining ring by means of pins whose breakage during unscrewing the cap 2, permits the opening of the bottle. The retaining ring is positioned between the lowest thread, indicated as 100, of the external screw thread 3 of the bottle and a circumferential projection 101, traditionally present in the neck 1 of plastic bottles.

According to the invention, rigidly connected to the cap 2 is at least one tamperproof device. Such a tamperproof device is housed in a convex band 7, joined to the skirt 6 to which it is tangentially linked. The convex band 7 has at the centre, in its concave part pointing towards the skirt 6, a cylindrical configuration that acts as a slide 22 for a pin 8 manually sliding along a direction y1 parallel to the central symmetry axis y of the cap 2 and, thence, of the bottle. One understands that the pin 8 behaves as a sliding bolt, since the traditional retaining ring above mentioned is made, in accordance with the invention, in the shape of ring nut 9 provided with a plurality of holes 10. The holes 10, that can be blind, as shown in FIGS. 2 and 3, but also through holes, have a hole axis y2 parallel to the sliding direction y1, so that the pin 8 can enter a hole 10 when a hole axis y2 coincides with the axis y1 of the pin.

Tamperproof devices of the kind being described can be applied on the cap 6 in the number desired. The convex band 7 is applied to the cap 6 according to the jointing lines 11 by ultrasound sticking, for instance, fusion, or any other known method. The convex band 7 has a cutout 12 for the manual sliding of the pin 8 during use, by an elongated projection 13 in the shape of a button to be activated, for example, with the thumb finger. The elongated projection 13 can be knurled externally to facilitate grip. The stroke downwards of the pin 8, defined by the vertical extension of the cutout 12 is determined by the ring nut 9. The lower end of the cutout 12 which acts as a stop for the elongated projection 13 of the pin 8 is indicated as 14.

In addition, the convex band 7 can have a retaining ring 15 in the form of an O-ring interacting with an enlarged tract 16 of the pin 8 to retain the pin during the assembly of the convex band 7 to the skirt 6 of the cap, as well as in a resting position, i.e. before activating the pin after the assembly of the tamperproof device.

The pin 8 has a weakened tract 17 along its length and an arrow-tip or umbrella shaped end 18. The weakened tract 17 can be obtained by a simple cross-section reduction, preferably constant, as compared to the rest of the pin 8. As seen later on, the weakened tract 17 allows a preset breakage of the pin 8.

Preferably, each hole 10 of the ring nut 9 is provided with an inlet 19 that is tapered downwards and intended to receive and retain the arrow-tip end 18 of the pin 8. In order to facilitate the insertion and retention of the arrow-tip end 18, the inlet 19 presents carvings 20 as shown in FIG. 2.

During use, after the first opening of the bottle, by unscrewing the cap 2 and separating the same from the ring nut 9, the user can drink directly from the bottle or pour its content into a glass. If the user shall go away and leave the bottle carefree, once the bottle is reclosed, the user can move the pin 8 in its slide 22 inside the convex band 7 by operating with the thumb on the elongated projection 13 until inserting the arrow-tip end 18 of the pin 8 in a hole 10 of the ring nut 9. The tapered inlet 19 of the hole 10 prevents the pin 8 from sliding upwards, blocking by such manner the unscrewing of the cap 2 from the bottle neck 1. If a person different from the user wants to unscrew the cap anyway in order to open the bottle, he/she would break the pin 8 in its weakened tract 17 located between the skirt 6 of the cap 2 and the ring nut 9, as shown in FIG. 3. A similar breakage of the pin 8 may occur if that person manually pulled up the pin 8 to return it in its original resting position.

Subsequently, the user becomes aware that the tampering occurred and, having evidence of it, the user would decide what to do with the bottle and its content.

If the user wants to keep using it, another tamperproof device, provided on the cap 2, can be employed in the same way as above described.

Figure 4:
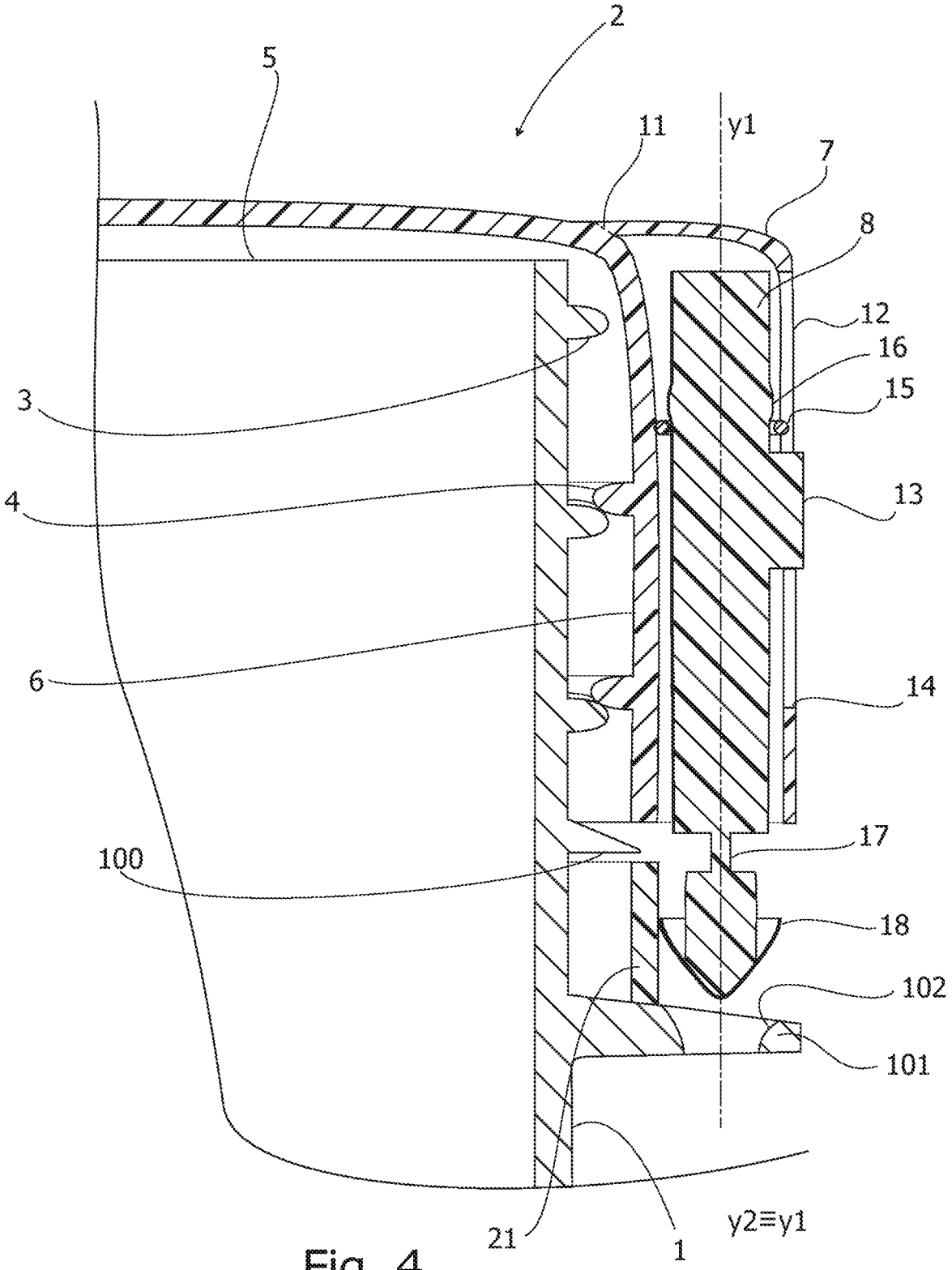
FIGS. 4 and 5 are cross sections, similar to FIGS. 2 and 3, of a second embodiment of a plastic bottle where a tamperproof device is different from that in FIG. 1.
Figure 5:
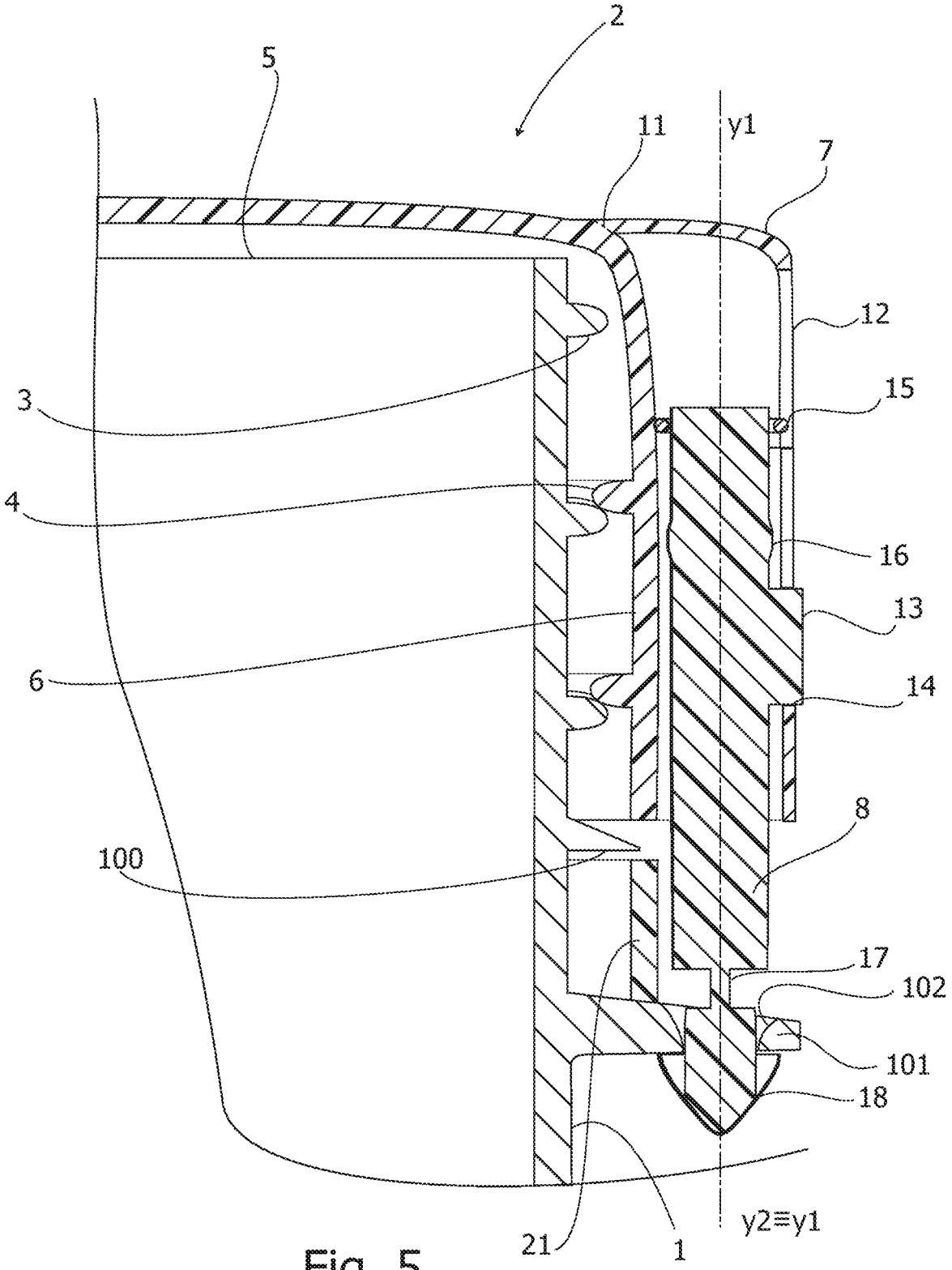

Now reference is made to FIGS. 4 and 5 that are cross-section views similar to those in FIGS. 2 and 3, of a second embodiment of a plastic bottle in which a tamperproof device differs from the one in FIG. 1 in the locking method of the arrow-tip end 18 of the pin 8. Same numbers are assigned to same parts or similar to those in the first embodiment. The same parts will not be described anew, either with regards to their structure, or to their operation. The cap 2 has a regular retaining ring indicated as 21. In FIG. 4 the skirt 6 of the cap 2 is already separated from the retaining ring 21, because of the occurred opening of the 10 bottle and breakage of its sealing that is provided by regular connecting pins (not shown) between the skirt 6 and the retaining ring 21 of the cap 2.

In accordance with the second embodiment of the invention, through holes 102 are made in the circumferential projection 101 of the bottle neck 1.

One of the through holes 102 is intended to receive and hold the arrow-tip end 18 of the pin 8. When the pin 8 is inserted in the through hole 102, the upward sliding of the pin 8 is made impossible. Therefore, the cap 2 cannot be unscrewed unless through the breakage of the weakened tract 17 of the pin 8.

It should be understood that the present invention can find application also in other screw-capped food containers, like plastic or paper jars.

It should be evident that both the pin 8 and its slide 22 and seat 7 can be made in a manner different from the one represented. The scope of protection of the invention is the one in the claims here attached.

The invention claimed is:

1. Plastic bottle equipped with a tamper-proof device after its opening, comprising:

a bottle neck in plastic, having a screw thread with a lowest thread and a circumferential projection, a cap, also in plastic, having:

a corresponding screw thread, a skirt of the cap having a central symmetry axis, at least a slide in the skirt, a pin manually slidable in the slide along a sliding direction parallel to the central symmetry axis of the cap, the pin having a weakened section in the direction of its length, an arrowtip end, and an elongated projection for the manual sliding of the pin in the slide, and a cap retaining ring or ring nut, separable from the cap, positioned between the lowest thread of the screw thread of the bottle and the circumferential projection, in the bottle neck, wherein the cap retaining ring or ring nut is provided with a plurality of holes and wherein the pin is insertable in one of the plurality of holes intended to receive and retain the arrow-tip end of the pin, said one of the plurality of holes preventing the release of the pin except by breakage of the weakened tract of the pin during a rotation of the cap in an attempt of opening the bottle.

2. Bottle according to claim 1, characterized in that each hole of the plurality of holes of the ring nut has an inlet tapered downwards to retain the arrow-tip end.

3. Bottle according to claim 2, characterized in that the inlet has carvings to increase its flexibility during the insertion of the arrowtip end.

4. Bottle according to claim 1, characterized in that the slide of the pin is contained inside a convex band joined to the skirt of the cap and includes a pin retaining ring.

5. Bottle according to claim 4, wherein the convex band has a cutout for the elongated projection of the pin, the cutout having a lower end acting as a stop for the pin.

6. Bottle according to claim 5, wherein the pin has an enlarged tract which engages at resting position said pin retaining ring, before the manual sliding of the pin.

* * * * *